United States Patent [19]

Jones et al.

[11] Patent Number: 4,753,844

[45] Date of Patent: Jun. 28, 1988

[54] DISPOSABLE SEMI-MOIST WIPES

[75] Inventors: Jack D. Jones, Guttenberg; Ashwin Gandhi, Toms River; Arlette Girgis, Kearney, all of N.J.

[73] Assignee: Airwick Industries Inc., Carlstadt, N.J.

[21] Appl. No.: 114,600

[22] Filed: Nov. 5, 1987

Related U.S. Application Data

[63] Continuation-in-part of Ser. No. 938,014, Dec. 4, 1986, Pat. No. 4,725,489.

[51] Int. Cl.[4] ..... D04H 1/58

[52] U.S. Cl. ..... 428/288; 428/289; 428/290; 428/296

[58] Field of Search ..... 428/288, 289, 290, 296

[56] References Cited

U.S. PATENT DOCUMENTS 4,624,890 11/1986 Lloyd ..... 428/289

4,666,621 5/1987 Clark et al. ..... 252/91

*Primary Examiner*—Marion C. McCamish

*Attorney, Agent, or Firm*—Felfe & Lynch

[57] ABSTRACT

A disposable article for interim cleaning of hard surfaces comprises a non-woven substrate, carrying an aqueous cleaning composition loaded onto the substrate at a level less than about 85%, preferably less than 75%, of its absorbence capacity. The aqueous composition comprises: optionally, one or more nonionic surfactants, one or more anionic surfactants or mixture of nonionic and anionic surfactants; a water miscible solvent for oils, (preferably a low molecular weight alcohol or N-methyl-2-pyrrolidone); and an alkalinity agent, such as ammonium hydroxide, in sufficient amount to maintain the pH of the extracted solution within the range of 8 to 12. The non-woven substance is preferably a non-chemically bonded fibrous material.

33 Claims, No Drawings

DISPOSABLE SEMI-MOIST WIPES

CROSS-REFERENCE TO RELATED APPLICATION

This is a continuation-in-part of our application Ser. No. 938,014 filed on Dec. 4, 1986, now U.S. Pat. No. 4,725,489.

FIELD OF THE INVENTION

This invention relates generally to disposable household articles suitable for cleaning of windows and other hard surfaces, ranging from those with high gloss to those with none at all. More particularly, it relates to semi-moist wipers which comprise a non-woven substrate impregnated, at a level significantly below their maximum absorbence capacity, with an aqueous composition containing as essential ingredients one or more solvents and/or one or more surfactants. These wipes are intended principally for cleaning windows and for cleaning of kitchen surfaces such as sinks, counter tops, refrigerators (interior and exterior) tile and stove tops where there may be moderate amounts of grease oil and dirt.

BACKGROUND OF THE INVENTION

Traditionally, hard surfaces such as porcelain-finish sinks, counter tops and tile walls, have been cleaned by various compositions such as a particulate detergent, from which the user prepares an aqueous solution or suspension, or a liquid composition which contains a suitable solvent such as water, an organic solvent, or mixture thereof, and one or more surfactants. These compositions can provide satisfactory soil removal from hard surfaces, but they often leave behind residues once the solvent medium has been permitted to evaporate or has been wiped off. In particular, if the surface is left to dry naturally, there often result residues in the form of dull streaks, rather than the desired bright and shiny surfaces. Such residues have to be removed by polishing with a dry cloth.

Where one is seeking to do heavy duty cleaning, the requirement of a two-step process for restoration of bright shiny surfaces is acceptable. However, when less intense cleaning is necessary—such as, for example, removal of moderate amounts of grease and soils from kitchen surfaces13 a two-step process is not desirable. Where the surface to be cleaned is not heavily soiled, it would be most advantageous to be able to clean the surface with a single application and to have it dry naturally to a streak-free bright and shiny condition. The principal object of this invention is to develop a product of this type.

The cleaning of windows and mirrors presents special problems when one is seeking to do so by a one-step operation. A product which leaves no visible streaks or film on most kitchen or bathroom surfaces may not give similar results on mirrors and windows in that a film which would be invisible on, for example, porcelain or tile, may be visible on a mirror. Therefore, an object of this invention to develop a product which provides streak- and film-free cleaning of mirrors and windows in a one-step operation.

There are numerous products on the market comprising absorbent substrates impregnated with liquid compositions. Some of these are designed for personal use and these include articles such as pre-moistened towelettes individually wrapped in moisture-impervious sealed envelopes. Similarly designed products, which generally require pre-wetting prior to use, are sold as hard surface cleaners for household and industrial use. The principal utility for such products is in areas such as floors or non-shiny surfaces where a certain amount of streaking is acceptable. However, where such products are used on shiny surfaces, such as those made of laminated plastic materials, porcelain or materials having a porcelain-like finish, an additional polishing step is often required in order to prevent streaking or to remove streaks. This streaking or filming problem has heretofore prevented the commercial development of a one-step disposable wipe for household use on shiny surfaces.

In liquid-containing wiping articles of this type, the substrate must function as reservoir which first distributes the liquid on the surface to be cleaned and then collects the dirt and oils from the surface. Because of this dual function, it is obviously not possible to have a substrate which is fully or nearly fully loaded to its absorbence capacity with liquid because, if this were the case, the substrate could not function as a collector of dirt and grease, particularly if the surface to be wiped has some standing liquid. In designing a product which will satisfactorily work as a one-step disposable wipe and not leave behind film or streaks, there are number of variables to manage. These include the composition of the substrate itself, the absorbent characteristics of the substrate, the loading level of liquid onto the substrate, the components and characteristics (e.g. pH) of the liquid composition, the amount of standing liquid on the surface to be cleaned, etc. All of these factors are interrelated and it has been found that close control is necessary in order to obtain a satisfactory product.

In our co-pending application Ser. No. 938,014 filed Dec. 4, 1986, we disclose disposable semi-moist wipes suitable for light duty cleaning of various household surfaces, particularly bathroom surfaces. Pertinent portions of said application are incorporated herein by reference. When it is desired to extend the concept of semi-moist disposable wipes to use on kitchen surfaces and for windows, certain improvements and refinements of the concept are necessary.

DESCRIPTION OF THE PRIOR ART

Rentz U.S Pat. No. 995,940, Miller U.S. Pat. No. 2,980,941, Schwuger U.S. Pat. No. 3,954,642, Muoio U.S. Pat. No. 3,965,518, Hermann U.S. Pat. No. 3,965,519, Meitner U.S. Pat. No. 4,307,143 and Barby U.S. Pat. No. 4,448,704 disclose various disposable wipes in the form of impregnated paper, textile fabric or non-woven articles for use in cleaning hard surfaces. The content of these references is discussed in more detail in the above-noted co-pending application. Many of them disclose products which are not suitable for household use and, for those which are suitable for household use, the disclosed compositions are such that they would be likely to leave behind either a particle-containing or a film deposit, thus not fulfilling our objective to provide one-step interim cleaning with substantially streak-free and film-free results.

Lloyd U.S. Pat. No. 4,624,890 discloses wiping cloths which contain, as dirt capture agents, cationic polyacrylamides (or certain derivatives thereof) incorporated into a substrate, which is preferably a flat flexible sheet of paper, woven, knitted or non-woven fabric. The wiping cloths are said to give streak-free results.

SUMMARY OF THE INVENTION

This invention provides a disposable article for one-step cleaning of mirrors and windows and for one-step interim cleaning of hard surfaces. The article comprises a non-woven substrate carrying an aqueous composition loaded onto the substrate at a level considerably less than its maximum absorbence capacity. The substrate consists essentially of cellulosic material such as cotton or rayon, polyolefins, polyester, nylon or mixtures thereof and is preferably a non-chemically bonded material, such as a powder bonded, thermally bonded or hydraulically interlaced fibrous material. The aqueous solution comprises: from about 5 to about 70 wt. % of one or more water miscible solvents for grease and dirt, such as N-methyl-2-pyrrolidone or a low molecular weight alcohol; as an alkalinity agent, ammonia or an alkali metal hydroxide in an amount sufficient so that the extracted pH of the solution is within the range of 8 to 12, preferably 9 to 11; and, optionally, one or more nonionic surfactants, or one or more anionic surfactants, or a mixture of anionic and nonionic surfactants. Additionally, the solution may contain disinfectants, colorant, fragrance, buffering agents, etc.

DETAILED DISCLOSURE

The semi-moist wipes of this invention comprise an absorbent substrate carrying an aqueous liquid composition which is impregnated into the substrate. These wipes are useful for one-step cleaning of windows and mirrors and for one-step interim cleaning of kitchen surfaces. The semi-moist wipes of this invention carry an aqueous liquid composition which comprises from about 5% to 70% of a water miscible solvent for grease and dirt, the amount of solvent employed being dependent upon the intended use of the impregnated wipe. A principal difference between the semi-moist wipes of this invention and those disclosed in the prior application Ser. No. 938,014 is that a higher concentration of such water miscible solvents is permitted. Additionally, it has been found that the absorbent substrate, both for one-step interim cleaning of kitchen surfaces and for one-step cleaning windows and mirrors, is preferably a sheet made of hydraulically interlaced fibers; however, for cleaning of kitchen surfaces, a substrate made of thermally bonded or powder bonded fibers made also be preferably employed, and use of a chemically bonded substrate will also give good results.

When cleaning kitchen surfaces, one generally requires a heavier duty cleaner than when one seeks to remove "bathroom soil" for various surfaces in the bathroom. Bathroom soil generally includes particulate material an other diverse matters such as spilled make-up, soap scum, toothpaste, hard water spots, hair spray residue, fingerprints, etc. In general, bathroom soil includes a relatively low level of "oily soil" and a semi-moist wipe for such bathroom soils can be described as being for "touch-up" or "light duty" cleaning. With kitchen surfaces, however, one generally must deal with a higher level of oils and greases, such as residues from cooking oil, meat products, dairy products, etc., as well as particulate matter derived from dust, cigarette ashes, the cleaning of vegetables, etc. Thus, when one wishes to adapt the semi-moist wipes technology suitable for light duty cleaning of bathroom surfaces to the interim cleaning of kitchen surfaces, it has generally been found necessary to use a "heavier duty" approach. Specifically, as will be discussed in more detailed below, it has been found that the use as substrates of sheets made of non-chemically bonded fibers, such as thermally bonded fibers or hydraulically interlaced fibers, gives generally better results. However, chemically bonded substrates may also be used particularly where the kitchen surface to be cleaned does not have a high gloss finish. Furthermore, better results are also attained when the aqueous composition contains somewhat higher amounts of solvent and/or surfactant(s)for grease and dirt. When used in connection with one-step cleaning of kitchen surfaces, the term "interim cleaning" refers to the removal of grease spots, oils, dirt and other particulate matter, food residues, water stains, soap scum, etc., particularly when they are on kitchen counters, faucets, backsplashes, refrigerator shelves, refrigerator exteriors, and similar areas. The term "interim cleaning" can also be applied to ambient cleaning of stove surfaces to the extent that such cleaning is not designed to remove large amounts of grease and other liquids caused by spillage, or to remove baked-on residues, etc. The interim cleaning contemplated herein can also include the wiping of ambient grease, oily and particulate material from small floor areas, although the semi-moist wipes of this invention are not primarily contemplated for the cleaning of floors.

In the one-step cleaning of windows and mirror surfaces, other considerations apply. In general, one will encounter less grease and oily dirt on window and mirror surfaces, although the interior of kitchen windows may present an oily dirt problem. Primarily, the problems encountered in preparing a one-step cleaner for windows result from the fact that streaks and film which are not visible on kitchen and bathroom surfaces, even on porcelain and porcelain-like surfaces, may turn out to be visible on windows. Therefore, a semi-moist wipe which gives streak-free results on other surfaces may not give the same results on window and mirrors. Furthermore, external and internal glass surfaces present different cleaning problems. The dirt on external window surfaces is mainly particulate matter comprising dust, soil particles, salt, etc., with minor amounts of oily film caused by atmospheric and automotive pollutants. In contrast to outside surfaces where the major problem is particulate material, the cleaning problems presented on interior surfaces are mainly in the nature of oily films, with minor amounts of household dust particles. In designing a one-step semi-moist wipe product for use on both exterior and interior window surfaces, including mirrors, a delicate balance of ingredients must be attained. As far as "light duty" versus "heavier duty" cleaning is concerned, most window and mirror cleaning falls into the "light duty" category, described more fully in our earlier application Ser. No. 938,014. However, the stricter standard for streak- and film-free results necessitates the use of higher levels of solvent for oil and dirt than would be needed for removal of bathroom soils, and requires that particular attention be given to the substrates. As to the surfactants chosen, this stricter standard causes a preference for nonionic, rather than anionic substances. Furthermore, because of the higher solvent level, the surfactant can be omitted altogether.

Although the one-step interim cleaning of kitchen surfaces and the one-step cleaning of windows and mirrors constitute different applications of the one-step cleaning concept, many of the requirements—particularly as to the concentration of water-miscible solvent and the substrate compositions—are similar for both intended applications. Therefore, unless otherwise specified herein, the following detailed description is applicable to wipes designed for both kitchen surface and window or mirror application.

The substrate is a flat flexible non-woven sheet having sufficient wet strength and consisting essentially of cellulosic material, such as cotton and rayon, polyolefins such as polyethylene, polypropylene or ethylene-propylene copolymer, polyester (polyethylene terephthalate), nylon and mixtures thereof. Preferably, the substrate is a cellulosic material from natural sources (wood pulp, cotton) or a blend of such cellulosic material with one or more of the foregoing synthetic materials. Its basis weight and liquid retention characteristics should be within specified ranges. Since the substrate must act as a reservoir for both an aqueous cleaning solution and oily residue removed from a surface, the substrate must exhibit both hydrophilic and oleophilic properties. For purposes of this invention, the fibers may be processed into the non-woven substrate by non-chemical means such as air laying, hydraulic lacing or (where composed of a sufficient amount of suitable synthethic fibers) thermal bonding. For use on kitchen surfaces, hydraulically interlaced or thermally bonded substrates are preferred, but chemically bonded substrates can also be used as in appropriate circumstances. For window cleaning purposes, hydraulically interlaced substrates give the best results, but other non-chemically bonded substrates can also be used.

The non-woven cellulose-containing substrate which is preferably used in the practice of this invention may be a fibrous sheet material having a basis weight between about 1 and about 4.5 ounces per square yard (about 34 and 153 grams per square meter), preferably from 1.5 to 3.5 ounces per square yard (about 51 to 119 grams per square meter). Particularly suitable are substrates comprising from 50 to 70 wt. % cellulosic material and from 30 to 50 wt. % polyester having a basis weight of from about 1.7 to 2.2 ounces per square yard (about 60 to 75 grams per square meter). The substrate should have a sufficiently closed structure so that no contact occurs between the user's fingers and the surface being wiped. The higher the basis weight of the paper, the more porous the structure can be without allowing such undesirable hand contact. To avoid such problems, sheets of larger area can be prepared and the consumer directed to use them in folded or balled condition. However, it is preferable that they have a basis weight of at least 2 ounces per square yard (68 grams per square meter) and that they be prepared in the form of sheets of from about 70 to about 100 square inches (about 450 to about 650 square centimeters), preferably 80 to 90 square inches (about 516 to about 580 square centimeters). Sheets of about 8 inches by 10½ inches (about 20 cm by 27 cm) or about 8 inches by 12 inches (about 20 cm by 30 cm) are particularly useful. For sheets of these sizes, a tight closed structure is desirable.

Also suitable are blends of cellulosic material with the above-mentioned synthetic materials such as, for example, blends of natural cellulosic material with rayon, with polypropylene, and with both polypropylene and rayon. Preferred blends are those in which the natural cellulosic material comprises at least about 40 weight percent of the blend.

Also of interest are non-woven sheets composed of fiber blends of rayon (regenerated cellulose) and one or more of the synthetic fibers, i.e. polyolefin, polyester, and nylon. Blends can offer advantages of economy, tactile properties, and/or a better balance of hydrophilic and oleophilic properties. If the nature of the soil to be removed is primarily greasy, then a substrate with enhanced oleophilic properties would contribute to superior pickup and retention of this class of soils. The use of one or more synthetic fibers in the blend is particularly valuable in this regard. For example, such a substrate may be composed of 40–80 percent rayon with the balance being 20–60 percent of polyester or of a polyolefin such as polyethylene, polypropylene or ethylene-propylene copolymer.

The maximum quantity of a liquid which can be carried by an absorbent substrate is determined by the total capacity of the substrate to carry said liquid without dripping. This quantity can be termed "absorbence capacity" and, since this invention is concerned with liquid compositions in which water can be a major constituent, absorbence capacity for the substrates usable in this invention can conveniently be regarded as identical to their maximum liquid loading level for water. For use in this invention, these substrates should have an absorbence capacity by weight for water at least 200% of the weight of the substrate. Advantageously, the absorbence capacity should be from about 300% to about 1200%, preferably from about 600% to 1000%.

The substrates used in the practice of this invention should be substantially free of any materials which would be leached out by the liquid composition and deposited on the wiped surface as streaks. Therefore, care must be taken in choosing substrates free of such potential "contaminants" as particular bonding agents, size, clays, fluorescent whitening agents, emulsifiers, or other inappropriate processing materials. Similarly, the use of chemically bonded substrates is not preferred, particularly when the intended use of the semi-moist wipe is for windows and mirrors. Suitable products for substrates include the following:

| SUBSTRATE TYPE | BASIS WT. | FIBER MIX | TRADE NAME | MANUFACTURER |
|---|---|---|---|---|
| Hydraulically interlaced fibers | 2.3 oz./yd$^2$ (78 g/m$^2$) | 70/30 Rayon/polyester | Sontara 8423 | Du Pont |
| Hydraulically interlaced fibers | 2.0 oz./yd$^2$ (68 g/m$^2$) | 55/45 Cellulose (Wood pulp)/polyester | Sontara 8801 | Du Pont |
| Air lay | 2.5 oz./yd$^2$ (85 g/m$^2$) | 100 Cellulose (wood pulp) | 852 | Fort Howard |
| Thermally bonded | 2.0 oz./yd$^2$ (68 g/m$^2$) | 50/50 rayon/polypropylene | Experimental grade | Scott Paper Company Company |
| Thermally bonded | 2.3 oz./yd$^2$ (78 g/m$^2$) | 70/30 Cellulose/polypropylene core and meltblown polypropylene laminate on both sides | Experimental Grade | Kimberly-Clark |
| Thermally bonded | 2.3 oz./yd$^2$ (78 g/m$^2$) | 80/20 Cellulose/polypropylene core and meltblown polypropylene laminate on both sides. | Experimental Grade | Kimberly-Clark |

The liquid cleaning composition carried by the substrate is in the form of a homogeneous aqueous solution which contains, in addition to water, one or more water-miscible solvents for oils and dirt, optionally one or more surface active agents, and sufficient ammonium or alkali metal hydroxide so that the pH of the extracted liquid is 8 to 12, preferably between 9 and 11.

Typical examples of suitable solvents are the lower aliphatic water-miscible alcohols having from 1 to 4 carbon atoms such as ethanol, propanol, isopropanol, butanol, etc. Other alcohols, such as tetrahydrofurfurol, may also be used. Glycols such as ethylene and propylene glycol and glycol ethers (Cellosolve), such as the monomethyl and dimethyl, propyl, isopropyl, butyl, and isobutyl ethers of di- and triethylene glycol and of analogous propylene glycols may also be used. Such glycols and glycol ethers have from 2 to 8 carbon atoms, and include particularly butyl Cellosolve. For kitchen surface cleaning, N-methyl-2-pyrrolidone and related compounds are particularly useful. Also useable are volatile silicones, particularly in admixture with one or more of the foregoing solvents. The preferred solvents are $C_2$ and $C_3$ aliphatic alcohols, especially ethanol and isopropanol, and particularly a 50/50 mixture of ethanol and isopropanol. Solvent mixtures of lower alcohols and N-methyl-2-pyrrolidone are especially preferred for cleaning of kitchen surfaces. Such solvents, which can include other mixtures, should be present in an amount ranging from about 5 to about 70 weight percent, of the aqueous solution. For kitchen surface cleaning, the preferred range of solvent is from 7 to 50 weight percent if N-methyl-2-pyrrolidone comprises at least 10% of the solvent; otherwise, the preferred range is from 9 to 60 weight percent. For window and mirror cleaning, the preferred range is from 20 to 70 weight percent, more preferably from 25 to 50 weight percent.

Surfactants useable in the aqueous composition are nonionic and anionic surfactants. The function of the surfactant is to disperse solid and particulate soils when the moistened wipe contacts the soiled area and to enhance their absorption into the substrate. With higher levels of solvent in the composition, such as for example, where solvents constitute more than about 20 weight percent, the surfactant can be eliminated.

Suitable nonionic surfactants include the condensation products of ethylene oxide with a hydrophobic (oleophilic) polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic surfactants (BASF Wyandotte Corp.), especially those in which the polyoxypropylene ether has a molecular weight of about 1500–3000 and the polyoxyethylene content is about 35–55% of the molecule by weight, i.e. Pluronic L-62.

Other useful nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ secondary alkyl alcohols with 3–50 moles of ethylene oxide per mole of alcohol which are commercially-available as the Poly-Tergent SLF series from Olin Chemicals or the Tergitol series from Union Carbide, i.e. Tergitol 25-L-7, which is formed by condensing about 7 moles of ethylene oxide with a $C_{12}$–$C_{15}$ alkanol.

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e. the Igepal CO series (GAF Corp.).

Preferred nonionic surface active agents, particularly for window and mirror cleaning, include alkyl polyglycosides (APG), derived as a condensation proudct of dextrose (D-glucose) and a straight or branched chain alcohol. The glycoside portion of the surfactant provides a hydrophile having high hydroxyl density which enhances water solubility. Additionally, the inherent stability of the acetal linkage of the glycoside provides chemical stability in alkaline systems. Furthermore, unlike some nonionics, alkyl polyglycosides have no cloud point, allowing one to formulate without a hydrotrope, and these are very mild, as well as readily biodegradable, nonionic surfactants. This class of surfactants is available from Horizon Chemical under the trade names of APG-300, APG-350, APG-500, and APG-500.

Another useful class of nonionic surfactant is the silicone-glycol copolymers. These surfactants are prepared by adding poly(lower)alkylenoxy chains to the free hydroxyl groups of dimethylpolysiloxanols and are available from the Dow Corning Corp as Dow Corning 190 and 193 surfactants (CTFA name: dimethicone copolyol.) These surfactants function, with or without any volatile silicones used as solvents, to control foaming produced by the other surfactants, and also impart a shine to metallic, ceramic, and glass surfaces.

Anionic surfactants suitable due to their high detergency include anionic detergent salts having alkyl substituents of 8 to 22 carbon atoms such as the water-soluble higher fatty acid alkali metal soaps, e.g., sodium myristate and sodium palmitate. A preferred class of anionic surfactants encompasses the water-soluble sulfated and sulfonated anionic alkali metal and alkaline earth metal detergent salts containing a hydrophobic higher alkyl moiety (typically containing from about 8 to 22 carbon atoms) such as salts of higher alkyl mono- or polynuclear aryl sulfonates having from about 1 to 16 carbon atoms in the alkyl group (e.g., sodium dodecylbenzenesulfonate, magnesium tridecylbenzenesulfonate, lithium or potassium pentapropylenebenzenesulfonate). These compounds are available as the Bio-Soft series, i.e. Bio-Soft D-40 (Stepan Chemical Co.).

Other useful classes of anionic surfactants include: the alkali metal salts of alkyl naphthalene sulfonic acids (methyl naphthalene sodium sulfonate, Petro AA, Petrochemical Corporation); sulfated higher fatty acid monoglycerides such as the sodium salt of the sulfated monoglyceride of coco oil fatty acids and the potassium salt of the sulfated monoglyceride of tallow fatty acids; alkali metal salts of sulfated fatty alcohols containing from about 10 to 18 carbon atoms (e.g., sodium lauryl sulfate and sodium stearyl sulfate); sodium $C_{14}$–$C_{16}$-alpha-olefin sulfonates such as the Bio-Terge series (Stepan Chemical Co.); alkali metal salts of sulfated ethyleneoxy fatty alcohols (the sodium or ammonium sulfates of the condensation products of about 3 moles of ethylene oxide with a $C_{12}$–$C_{15}$ n-alkanol, i.e., the Neodol ethoxysulfates, Shell Chemical Co.); alkali metal salts of higher fatty esters of low molecular weight alkylol sulfonic acids, e.g. fatty acid esters of the sodium salt of isothionic acid, the fatty ethanolamide sulfates; the fatty acid amides of amino alkyl sulfonic acids, e.g. lauric acid amide of taurine; as well as numerous other anionic organic surface active agents such as sodium xylene sulfonate, sodium naphthalene sulfonate, sodium toulene sulfonate and mixtures thereof.

A further useful class of anionic surfactants includes the 8-(4-n-alkyl-2-cyclohexenyl)-octanoic acids wherein the cyclohexenyl ring is substituted with an additional carboxylic acid group. These compounds or their potassium salts, are commercially-available from Westvaco Corporation as Diacid 1550 or H-240.

In general these anionic surface active agents are employed in the form of their alkali metal salts, ammonium or alkaline earth metal salts, since these salts possess the requisite stability, solubility, and low cost essential to practical utility.

For kitchen surface cleaning the preferred surface active agents are one or more nonionic surfactants which can optionally be combined with one or more anionic surfactants. However, one or more anionic surfactants can also be employed without any nonionic surfactant. For window cleaning, it is preferable to use only nonionic surfactants. In any event, foaming is not desired and therefore the surfactants should be chosen, and their relative content set, so as to minimize foaming. If the aqueous composition contains surfactants, the total amount of thereof can range from about 0.05 to about 2 percent by weight, preferably from 0.1 to 0.6 percent by weight.

It is necessary that the pH of the extracted solution be on the alkaline side, within a range of about 8 to about 12, preferably from 9 to 11. By "extracted solution" is meant the aqueous solution which is deposited from the substrate onto the surface to be cleaned. This extracted solution can be identical to the solution which is impregnated into the substrate but the substrate may contain additives which are acidic in nature and leach out into the solution causing a lowering of the pH. (In general such substances containing additive should be avoided for wipes intended to be used on windows.) To ensure that the extracted pH is within the proper limits, it may be necessary to produce an aqueous solution with a pH higher than 12 and/or to add a buffering agent. In order to achieve the desired alkalinity level, a minor amount of ammonium, sodium or potassium hydroxide is added.

The preferred alkalinity control agent is ammonia, because of its grease cutting characteristics and because of its traditional characteristic "clean" odor when used in small amounts. If ammonia is used, the weight percent range is from about 0.01 to about 0.75 percent, preferably from 0.1 to 0.2 percent.

It is also desirable to employ, as a preservative, one or more bacteriostatic or fungistatic agents. This is especially desirable where a natural cellulosic substrate is employed. Examples of such preservatives include such well known products as methyl and propyl paraben, 5-chloro-2-methyl-4-isothiazolin-3-one and 2-methyl-4-isothiazolin-3-one (Kathon CG, Rohm & Haas), potassium benzoate, and 1-(3-chloroallyl)-3,5,7-triaza-1-azonia-adamantane (Dowicil 75). Since a significant portion of the aqueous solution consists of water, it is important that the preservative be water soluble; a preferred preservative from this standpoint is 1-(3-chloroallyl)-3,5,7-triaza-1-azonia adamantane. If a preservative is used, it can be present in the range of from about 0.05 to about 0.3 weight percent, preferably from 0.1 to 0.2 weight percent, of the aqueous solution.

In addition to the solvent, surfactant and alkalinity agent, the aqueous solution preferably also contains a minor but effective amount of a fragrance selected so as to be chemically compatible with the other ingredients. Such fragrances are present in an amount ranging from about 0.02 to about 0.50 weight percent of the solution, preferably from 0.1 to 0.3 weight percent. These fragrances include floral oils such as rose oil, lilac, jasmine, wisteria, lemon, apple blossoms or compound bouquets such as spice, woody, pine, oriental, and the like.

The solution, particularly if it is to be incorporated into a semi-moist wipe for cleaning windows, may also contain a minor amount, e.g. from about 0.05 to about 0.20 weight percent, of silicone fluid which serves to provide a shine to the glass surface and as soiling retardant. Suitable silicones include, for example, linear polymethylsiloxanes or tetrameric or pentameric cyclosiloxanes.

Additional optional ingredients which can be included in the aqueous solution include colorants and disinfectant. Again, in order to promote streak-free effectiveness, these optional ingredients must be water soluble.

The water used in the aqueous solution should preferably be distilled water. De-ionized water can also be used.

It is critical to the effectiveness of the subject semi-moist wipes that the aqueous detergent solution be loaded into the substrate at a level considerably less than its absorbence capacity. In general, the liquid loading level should not exceed about 85% of the substrate's absorbence capacity, preferably should not exceed 75%, and more preferably should not exceed 50%, of the absorbence capacity. In order to function as a means for distributing the aqueous cleaning solution and as a means for completely absorbing bathroom soils, the substrate must have a significant amount of reserve absorbant capacity. For example, if a substrate has an absorbence capacity within the preferred range of 600% to 1000%, it can preferably be loaded with aqueous solution in an amount ranging from about 1.0 to about 4.0 times its weight, preferably from about 1.5 to about 3.0 times its weight. Using, as a specific example, a cellulose blend substrate sheet of 20 cm by 27 cm (8 inches by 10½ inches) having a weight of 5 grams and an absorbence capacity of 40 grams (800%), a satisfactory loading level of aqueous solution would be from about 7.5 grams to about 15.0 grams (1.5 to 3.0 times the weight of the substrate). Below the lower loading level of 7.5 grams, satisfactory cleaning is not attained. At a loading above the upper level, the wipe does not readily absorb all the liquid deposited on the surface. A preferred loading level range for this particular substrate is from 8.5 grams to 11.5 grams (1.7 to 2.3 times the weight of the substrate), with about 10.0 grams (2.0 times weight of the substrate) being optimal. At these levels, there is enough cleaning solution to solubilize and pick up soils. Enough of the surface is covered in a single pass and the user has a perception of adequate cleaning action. Also, the excess "reservoir" capacity of the substrate works well as an uptake and effectively removes all the liquid and solid material, leaving behind no residue. The preferred and optimum loading levels will vary according to the composition of the aqueous solution and, more significantly, according to the nature of the substrate. Thus, with a different substrate, the preferred loading level ranges may exceed or fall well short of the ranges for this specific example. For example, a semi-moist wipe designed for window cleaning, which has a aqueous solution having 25% alcohol, can, because of the alcohol's volatility, be loaded to a somewhat higher level. The determination of suitable liquid loading levels for a particular substrate and for a particular use is well within the ability of persons skilled in the art.

The wipes of this invention, being of the moist impregnated type, must be packaged in such a way as to avoid the lost of volatile material by evaporation. The wipes may, for example, be packaged individually in moisture-proof sachets comprised of metal foil and/or plastic film. Alternatively, a continuous roll of moistened substrate, perforated at intervals, can be packaged in a container with a tight closure.

This invention will be further illustrated by the following non-limiting examples.

EXAMPLES

In Examples 1 through 10, aqueous solutions usable in the practice of this invention were prepared. These solutions had the following content.

EXAMPLE 1

| Ingredient | Function | Wt. % |
|---|---|---|
| Isopropyl alcohol | Solvent | 5.00 |
| N—methyl-2-pyrrolidone | Solvent | 2.00 |
| Alcohol ethoxy-sulfate salt (Neodol 25-3A, Shell Chemical) | Anionic Surfactant | .15 |
| Ammonium hydroxide | Alkalinity | .15 |
| Perfume | Fragrance | .20 |
| Distilled water | Diluent | 92.50 |
| | | 100.00 |

EXAMPLE 2

| Ingredient | Function | Wt. % |
|---|---|---|
| Dipropylene glycol methyl ether | Solvent | 3.00 |
| Propylene glycol methyl ether | Solvent | 3.00 |
| Isopropyl alcohol | Solvent | 3.00 |
| Alcohol ethoxy-sulfate salt (Neodol 25-3A, Shell Chemical) | Anionic Surfactant | .15 |
| Ammonium hydroxide | Alkalinity | .15 |
| Perfume | Fragrance | .20 |
| Distilled water | Diluent | 90.50 |
| | | 100.00 |

EXAMPLE 3

| Ingredient | Function | Wt. % |
|---|---|---|
| Isopropyl alcohol | Solvent | 15.00 |
| Alkylpolyglycoside (APG-300, Horizon Chemical) | Nonionic Surfactant | .45 |
| Ammonium hydroxide | Alkalinity | .15 |
| Perfume | Fragrance | .20 |
| 1-(3-Chloroallyl)-3,5,7-triaza-1-azonia adamantane (Dowicil 75, Dow Chemical) | Preservative | .15 |
| Distilled water | Diluent | 84.05 |
| | | 100.00 |

EXAMPLE 4

| Ingredient | Function | Wt. % |
|---|---|---|
| Isopropyl alcohol | Solvent | 25.00 |
| Ethanol 190 (denatured) | Solvent | 25.00 |
| Ammonium hydroxide | Alkalinity | 0.15 |
| Perfume | Fragrance | 0.10 |
| Distilled water | Diluent | 49.75 |
| | | 100.00 |

EXAMPLE 5

| Ingredient | Function | Wt. % |
|---|---|---|
| Isopropyl alcohol | Solvent | 12.50 |
| Ethanol 190 (denatured) | Solvent | 12.50 |
| Ammonium hydroxide | Alkalinity | .15 |
| Perfume | Fragrance | .10 |
| Distilled water | Diluent | 74.75 |
| | | 100.00 |

EXAMPLE 6

| Ingredient | Function | Wt. % |
|---|---|---|
| Isopropyl alcohol | Solvent | 25.00 |
| Ethanol 190 (denatured) | Solvent | 25.00 |
| N—methyl-2-pyrrolidone | Solvent | .05 |
| Ammonium hydroxide | Alkalinity | .15 |
| Perfume | Fragrance | .10 |
| Distilled Water | Diluent | 49.70 |
| | | 100.00 |

EXAMPLE 7

| Ingredient | Function | Wt. % |
|---|---|---|
| Isopropyl alcohol° | Solvent | 25.00 |
| Ethanol 190 (denatured) | Solvent | 25.00 |
| Ammonium hydroxide | Alkalinity | .15 |
| Perfume | Fragrance | .10 |
| Polymethylcyclosiloxanes (Dow Corning 345 Fl., Dow Chemical Corp.) | Shine | .05 |
| Distilled water | Diluent | 49.70 |
| | | 100.00 |

EXAMPLE 8

| Ingredient | Function | Wt. % |
|---|---|---|
| Isopropyl alcohol | Solvent | 25.00 |
| Ethanol 190 (denatured) | Solvent | 25.00 |
| Ammonium hydroxide | Alkalinity | .15 |
| Alkylpolyglycoside (APG 300, Horizon Chemical) | Nonionic surfactant | .25 |
| Perfume | Fragrance | .10 |
| Distilled Water | Diluent | 49.50 |
| | | 100.00 |

EXAMPLE 9

| Ingredient | Function | Wt. % |
|---|---|---|
| Isopropyl alcohol | Solvent | 10.00 |
| Ethanol 190 (denatured) | Solvent | 10.00 |
| Ammonium hydroxide | Alkalinity | .15 |
| Perfume | Fragrance | .10 |
| Distilled Water | Diluent | 79.75 |

-continued

| Ingredient | Function | Wt. % |
|---|---|---|
| | | 100.00 |

EXAMPLE 10

| Ingredient | Function | Wt. % |
|---|---|---|
| Ethylene glycol monobutyl ether | Solvent | 8.00 |
| Ethanol | Solvent | 10.00 |
| Sodium lauryl ether sulfate, Empimin (Marchand Chemie) | Anionic surfactant | 0.80 |
| Paraffin sulfonates, Hostapur | Anionic surfactant | 1.20 |
| Perfume | Fragrance | 0.40 |
| Formaldehyde | Preservative | 0.10 |
| Water | Diluent | 79.50 |
| | | 100.00 |

EXAMPLE 11

Towelettes were prepared by loading 10 grams each of the solutions prepared according to Examples 1 through 3 onto cellulose sheets weighing about 5 grams and having dimensions about 8 inches by 10½ inches (20 cm by 27 cm). The cellulose sheets are grade 852, air lay nonwoven paper (100% wood pulp) from Fort Howard Paper Company. These towelettes were tested in the following manner.

A 12 inch by 4 inch (30 cm by 10cm) black ceramic tile was stroked three times by the moistened towelette, each stroke consisting of an upward and a downward uniform application. The tiles were permitted to dry for about 5 minutes and then rated on a scale of 0 to 10, with 0 being excellent and free of streaks and film, and 10 being extremely hazy, dull and covered with streaks.

The following table shows the results.

TABLE I

| |
|---|
| Example 1 = 1.0 |
| Example 2 = 0.5 |
| Example 3 = 0–0.5 |

It can readily be seen that the wipes prepared according to this invention gave excellent streak-free results, indicating that they would be useful for interim cleaning of kitchen surfaces and/or similar surfaces outside the kitchen.

In similar manner, a wipe comprising a 12 inch by 12 inch (30 cm by 30 cm) fibrous sheet having a basis weight of about 1 ounce per square yard (33 grams per square meter) was impregnated with the solution prepared according to Example 10. The substrate, supplied by Société Francaise des Non-Tissus, comprised 75% by weight of a mixture of cellulosic material and polyester and 25% by weight of an acrylic vinylic copolymer binder, had an absorbence capacity of 400% and was loaded to 25% of its absorbence capacity. Test results indicate similar utility for kitchen surfaces.

EXAMPLE 12

Towelettes were prepared by loading 14 grams of each of the solutions prepared according to examples 1 to 9, onto rayon/polyester sheets weighing about 5 grams and having dimentions of 8 inches by 12 inches (20 cm by 30 cm). The rayon/polyester sheets are Sontara grade 8423, from Du Pont. These towelettes were tested in the following manner.

An 8 inches by 8 inches (20 cm by 20 cm) mirror was stroked three times by the moistened towelette, each stroke consisting of an upward and downward unifrom application. The mirrors were permitted to dry for about five minutes and then rated on a scale of 0 to 10, as described in Example 11.

The following table shows the results.

TABLE II

| |
|---|
| Example 1 = 1.0 |
| Example 2 = 3.0 |
| Example 3 = 0.75 |
| Example 4 = 0.0 |
| Example 5 = 0.5 |
| Example 6 = 0.5 |
| Example 7 = 0.0 |
| Example 8 = 0.0 |
| Example 9 = 0.75 |

While all the wipes tested show satisfactory results, it can be seen that those prepared from solutions having no surfactant (Examples 4–7 and 9) or only nonionic surfactants (Examples 3 and 8) give somewhat better results than those prepared from solutions containing anionic surfactants (Examples 1 and 2).

We claim:

1. A disposable article for cleaning hard surfaces comprising, as non-woven substrate, a fibrous sheet consisting essentially of cellulosic material, polyolefins, polyester, nylon or mixtures thereof, and having a absorbence capacity for water of at least 200 weight percent, said substrate being impregnated to a level not exceeding about 85% of its absorbence capacity with an aqueous solution comprising from about 5 to about 70% by weight of a water miscible solvent for oils, and ammonium or an alkali metal hydroxide as an alkalinity agent in an amount sufficient to cause the pH of the extracted solution to be within the range of from 8 to 12.

2. A disposable article according to claim 1, in which the substrate is impregnated with the aqueous solution to a level not exceeding 75% of its absorbence capacity.

3. A disposable article according to claim 2, in which the substrate has a basis weight of between about 1 and about 4.5 ounces per square yard.

4. A disposable article according to claim 3, in which the non-woven substrate is a non-chemically bonded fibrous sheet.

5. A disposable article according to claim 4, in which the basis weight is from 1.0 to 3.5 ounces per square yard.

6. A disposable article according to claim 4, in which the absorbence capacity is from about 300 to about 1200 weight percent.

7. A disposable article according to claim 6, in which the absorbence capacity is from about 600 to about 1000 weight percent.

8. A disposable article according to claim 4, in which the substrate consists essentially of cellulosic material or of a blend of cellulosic material with a material selected from the group consisting of polyolefin, polyester, nylon and mixtures thereof.

9. A disposable article according to claim 4, in which the substrate is an hydraulically interlaced or a thermally bonded fibrous sheet.

10. A disposable article according to claim 9, in which the substrate is an hydraulically interlaced fibrous sheet.

11. A disposable article according to claim 10, in which the substrate is a blend of from about 50 to about 70 weight percent cellulosic material and from about 30 to 50 weight percent polyester.

12. A disposable article according to claim 9, in which the substrate is a thermally bonded fibrous sheet.

13. A disposable article according to claim 9, in which the substrate has a basis weight of from 1.5 to 3.5 ounces per square yard.

14. A disposable article according to claim 13, in which the absorbence capacity of the substrate is from 600 to 1000 weight percent.

15. A disposable article according to claim 14, in which the substrate is impregnated with the aqueous solution at a loading level range of from about 1.5 to about 3.0 times the weight of the substrate.

16. A disposable article according to claim 9, in which the substrate is a blend of from about 40 to about 80 weight percent rayon and from about 20 to about 60 weight percent of polyester.

17. A disposable article according to claim 4 which additionally comprises from about 0.05 to about 2% by weight of at least one nonionic surfactant, or at least one anionic surfactant, or a mixture of nonionic and anionic surfactants.

18. A disposable article according to claim 17, in which the surfactants are nonionic surfactants.

19. A disposable article according to claim 18, in which the surfactant is an alkyl polyglycoside.

20. A disposable article according to claim 19, in which the substrate is a hydraulically interlaced or thermally bonded fibrous sheet having a basis weight of from 1.0 to 3.5 ounces per square yard, the aqueous composition contains additionally a preservative in an amount of from about 0.05 to about 0.3 weight percent which is impregnated into the solution at a level of 1.5 to 3.0 times the weight of the substrate, the solvent is a mixture of isopropanol and about 10 to 20% N-methyl-2-pyrrolidone which is present in an amount of from 7 to 50 weight percent of the aqueous composition, and the alkalinity agent is ammonium hydroxide.

21. A disposable article according to claim 19, in which the substrate is a hydraulically interlaced fibrous sheet having a basis weight of from 1.5 to 3.5 ounces per square yard, the aqueous composition contains additionally a silicone fluid in an amount of from about 0.05 to about 0.2 weight percent which is impregnated into the solution at a level of 1.5 to 3.0 times the weight of the substrate, the solvent is a mixture of ethanol and isopropanol which is present in an amount of from 25 to 50 weight percent of the aqueous composition, and the alkalinity agent is ammonium hydroxide.

22. A disposable article according to claim 17, in which the surfactants are anionic surfactants.

23. A disposable article according to claim 17, in which the surfactants are present in an amount from 0.1 to 0.6 weight percent.

24. A disposable article according to claim 4, in which the solvent is selected from the group consisting of aliphatic alcohols having from 1 to 4 carbon atoms, tetrahydrofurfurol, glycols and glycols ethers having from 2 to 8 carbon atoms, volatile silicones, N-alkylpyrrolidone and mixtures thereof.

25. A disposable article according to claim 24, in which the solvent is a $C_2$ or $C_3$ alcohol, N-methyl-2-pyrrolidone or mixtures thereof.

26. A disposable article according to claim 25, in which the solvent is a mixture of ethanol and isopropanol.

27. A disposable article according to claim 25, in which the solvent is present in an amount of from 7 to 50 weight percent of the aqueous composition.

28. A disposable article according to claim 24, in which the solvent is present in an amount of from 9 to 60 weight percent of the aqueous composition.

29. A disposable article according to claim 4, in which sufficient alkalinity agent is added to the aqueous composition to maintain the pH of the extracted solution at a level from 9 to 11.

30. A disposable article according to claim 29, in which the alkalinity agent is ammonium hydroxide or sodium hydroxide.

31. A disposable article according to claim 30, in which the alkalinity agent is ammonium hydroxide.

32. A disposable article according to claim 2, in which the solvent is present in an amount of from 20 to 70 weight percent of the aqueous composition.

33. A disposable article according to claim 32, in which the aqueous solution additionally contains from about 0.05 to about 0.2 weight percent of a silicone fluid.

* * * * *